US009647400B2

(12) United States Patent
Atherton

(10) Patent No.: US 9,647,400 B2
(45) Date of Patent: May 9, 2017

(54) INDICATOR WAFER

(71) Applicant: John Atherton, Beaverton, OR (US)

(72) Inventor: John Atherton, Beaverton, OR (US)

( * ) Notice: Subject to any disclaimer, the term of this patent is extended or adjusted under 35 U.S.C. 154(b) by 0 days.

(21) Appl. No.: 14/726,314

(22) Filed: May 29, 2015

(65) Prior Publication Data

US 2016/0352053 A1 Dec. 1, 2016

(51) Int. Cl.

| | |
|---|---|
| ***H01R 3/00*** | (2006.01) |
| ***H01R 13/717*** | (2006.01) |
| ***H01R 13/66*** | (2006.01) |
| *H01R 103/00* | (2006.01) |
| *H01R 24/78* | (2011.01) |

(52) U.S. Cl.
CPC ..... *H01R 13/717* (2013.01); *H01R 13/6683* (2013.01); *H01R 24/78* (2013.01); *H01R 2103/00* (2013.01)

(58) Field of Classification Search
CPC ..... H01R 13/717; H01R 31/065
USPC ..... 439/490, 225, 638; 362/641, 95
See application file for complete search history.

(56) References Cited

U.S. PATENT DOCUMENTS

| | | | | |
|---|---|---|---|---|
| 2,449,150 A | | 9/1948 | Schnoll | |
| 3,171,113 A | * | 2/1965 | McNamara | H01R 13/648 200/51 R |
| 3,234,464 A | * | 2/1966 | Cook | G01R 19/155 324/122 |
| 3,753,261 A | * | 8/1973 | Thaxton | H01R 13/7177 340/649 |
| 3,872,383 A | * | 3/1975 | Kolodziej | G01R 19/145 324/508 |
| 4,002,397 A | * | 1/1977 | Wang | G08B 13/1409 340/568.4 |
| 4,520,239 A | | 5/1985 | Schwartz | |
| 4,671,597 A | * | 6/1987 | Grill | H01R 13/7177 324/133 |
| 6,827,602 B2 | * | 12/2004 | Greene | H01R 13/465 439/488 |
| 7,036,948 B1 | * | 5/2006 | Wyatt | H01R 13/717 362/276 |
| 7,862,350 B2 | * | 1/2011 | Richter | H01H 9/182 362/95 |
| 7,893,686 B1 | * | 2/2011 | Atherton | G01R 19/155 324/133 |
| 2006/0039136 A1 | * | 2/2006 | Probasco | H01R 13/652 362/157 |
| 2015/0340826 A1 | * | 11/2015 | Chien | A61L 9/03 439/490 |

OTHER PUBLICATIONS

3M Electrical Markets Division, 3M Fabric Tape CN-3190, Data Sheet, Sep. 2008, Austin, TX.

Home Depot, GE Single Grounded Outlet Adapter with Power Indicator Light—Clear, downloaded from http://www.homedepot.com/p/GE-Single-Grounded-Outlet-Adaptor- . . . , product sales offer, 2 pages, Apr. 17, 2015.

(Continued)

*Primary Examiner* — Abdullah Riyami
*Assistant Examiner* — Nelson R Burgos-Guntin
(74) *Attorney, Agent, or Firm* — Chernoff, Vilhauer, McClung & Stenzel, LLP

(57) ABSTRACT

An apparatus selectively connectable to the prongs of an electrical plug that provides an indication to a person of the presence of power to the prongs.

18 Claims, 1 Drawing Sheet

(56) References Cited

OTHER PUBLICATIONS

Amazon.com, Woods 4325C Single Outlet Power Adapter Plug with Lighted End, 15-Amp, Clear, downloaded from http://www.amazon.com/Woods-4325C-Single-Adapter-Lighted/dp . . . , product sales offer, 5 pages, Apr. 17, 2015.
Alibaba.com, Outdoor Extension Cords with Indicator Light, downloaded from http://www.alibaba.com/product-detail/Outdoor-Extension-Cords-wi . . . , product listing 3 pages, Apr. 17, 2015.
3M, 3M Shielding PET Rip-stop Fabric Tape CN-3190, downloaded from http://solutions.3m.com/wpx/portla/3M/en-US/Electronics_NA/Products/Electronics_. . . , product listing, 2 pages, May 29, 2015.

* cited by examiner

INDICATOR WAFER

CROSS-REFERENCE TO RELATED APPLICATION

None.

BACKGROUND OF THE INVENTION

The subject matter of this application relates to a device that selectively attaches to the prongs of an electrical plug and provides a visual indication of a voltage across the prongs.

Some modern electrical extension cords often include indicator lights indicating the presence of power in the extension cord. For example, U.S. Pat. No. 4,671,597 to Grill discloses an extension cord having a female receptacle into which the prongs of an electrical plug may be inserted. The female receptacle includes a lamp connected to respective conductors wired to the hot and neutral prongs of a male plug at the opposite end of the extension cord, so that the lamp is illuminated when the extension cord is plugged into an outlet. These same conductors are positioned so that they contact the hot and neutral prongs of any plug inserted into the extension cord. The reason for the indicator lamp of Grill is that extension cords often extend around walls or other obstacles that prevent a person from knowing whether the extension cord is plugged into an outlet at the time it is being used. The indicator lamp provides this indication.

Also, many existing power strips have indicator lights indicating the presence of a voltage potential at any (or all) of the sockets provided by the power strip. For example, some power strips include a switch that alternatingly provides voltage to all the sockets in the power strip or disables voltage to all the sockets in the power strip; a light indicates which of these two states the switch is set to. Still other power cords include such switches and/or lights to each of the sockets in the power strip. Again, as above with respect to the extension cord of Grill, the indicator lights provide an easy indication of the presence of power to the power strip's sockets.

BRIEF DESCRIPTION OF THE DRAWINGS

For a better understanding of the invention, and to show how the same may be carried into effect, reference will now be made by way of example to the accompanying drawings, in which.

DETAILED DESCRIPTION

As noted above, many existing extension cords and power strips include indicator lights that convey information about whether power is available in a socket that a plug may be, or is, inserted into. Thus, the absence of a light may indicate to a user that a plug of an extension cord needs to be inserted into a socket, or a switch of a power cord needs to be depressed. The present inventor noted, however, that such lights provide the additional functionality of informing a user that power is, or is not, being delivered to a device already plugged into a receptacle having such a light. Thus, when a device is plugged into a socket but is not working, a user may quickly determine whether the fault lies with the device, or with inadequate power being provided to the device.

However, a great number of appliances or devices are routinely plugged directly into a socket, as opposed to receiving power from a socket indirectly through an extension cord or a power strip. Given the impracticality of using an extension cord or a power strip for every device receiving power from a wall outlet, the present inventor therefore realized the need for an indicator light associated with a male plug of an appliance, rather than a female receptacle of an outlet, extension cord, or power strip. The present inventor also realized the benefit of a device that could be retrofitted on existing male electrical plugs.

Figure 1:
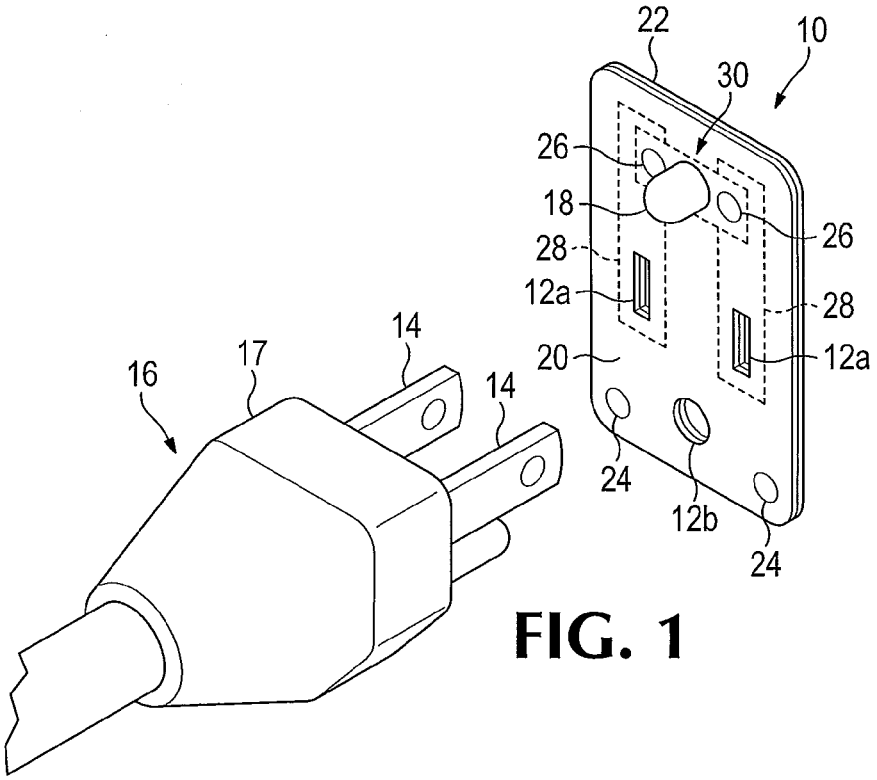
FIG. 1 shows a wafer having slots into which the prongs an electrical plug may be selectively inserted, and a light indicating the presence of a voltage across the prongs.

FIG. 1 shows an exemplary wafer 10 having a plurality of apertures 12*a* and 12*b* sized and arranged to receive the prongs 14 of a plug 16. In FIG. 1, apertures 12*a* are positioned and sized to receive the hot and neutral prongs of the plug 16, i.e. the prongs through which current flows when the plug is inserted into an outlet. Conversely, aperture 12*b* is sized and positioned to receive the ground prong of the plug 16. Though FIG. 1 shows a 3-prong plug ubiquitously used in the United States to be inserted into a standard 120V receptacle having positive, neutral, and ground terminals, those of ordinary skill in the art will appreciate that other embodiments of the wafer 10 may have apertures sized and arranged to receive prongs of different types of plugs used in the United States or other countries, e.g. NEMA 14-50 plugs, a CEE 7/4 plug used in Germany, etc.

Preferably, the wafer 10 is sufficiently thin so that the prongs 14 of plug 16 may be inserted into the apertures 12 such that they extend through the wafer 10 a sufficient distance so that the plug 16 may be inserted stably into an electrical outlet (not shown) and receive power from that outlet. Preferably, the wafer 10 is less than 1/8 inch thick and more preferably is less than 1/16 inch thick. In this manner, the wafer 10 may fit snugly between a rubber base 17 of the plug 16 and an outlet into which the prongs of the plug 16 are inserted.

The wafer 10 also includes a light 18 that illuminates when a plug 16, having prongs 14 inserted in the wafer, receives electrical power. That is to say, if the plug 16 is inserted through the wafer 10 and into an electrical outlet, the light 18 will illuminate if the electrical outlet delivers power to the plug 16, as explained more fully below. Preferably, the light 18 is positioned so that it is easily visible to a person while the plug 16 is inserted in an outlet. For example, as shown in FIG. 1, the wafer 10 may be sized so that it has a height greater than that of an inserted plug, with the light positioned above the plug to be easily seen when illuminated. In other embodiments, the light 18 may be positioned to the side of a plug inserted into the wafer 10, or any other appropriate, visible location.

In a preferred embodiment, the wafer 10 is made of a flexible material, such as a soft plastic, so that the wafer may bend when needed. For example, 120 volt electrical outlets commonly used in the United States are arranged in stacked pairs within a receptacle. Where, as shown in FIG. 1, the wafer 10 has a height greater than that of the plug, and is inserted between a plug and a socket, it may be desirable to bend the wafer 10 out of the way so that a second plug may be inserted in the other socket in the receptacle.

The exemplary wafer 10 is preferably fabricated using a very inexpensive procedure that requires neither precise tracing of an electrical path on a substrate between the apertures 12*a* and the light 18, nor bulky electrical contact pads positioned around the periphery of the apertures 12*a*. Preferably, the wafer 10 is made of two plies 20 and 22 of flexible plastic connected to each other by, e.g. fasteners 24 and/or 26. Between the plies 20 and 22 is inserted conductive fabric material 28 positioned to electrically connect each aperture 12*a* to a respective electrical contact 38 (shown in FIGS. 2 and 3), which are in turn electrically connected to the light 18. Conductive fabric material 28, such as 3M™ Fabric Tape CN-3190, may preferably comprise a flexible Nickel/Copper-plated backing material with a conductive acrylic adhesive layer. Such conductive fabric material is ordinarily used for electromagnetic shielding of circuitry, i.e. to block spurious electromagnetic fields that might otherwise interfere with sensitive electronic components shielded by the fabric. The present inventor realized that the high conductivity of such fabric requisite for shielding applications, provides an inexpensive alternative to either tracing an electrical path from an aperture 12*a* to the light 18, and/or providing bulky and precisely positioned contact pads around the periphery of the apertures 12*a*.

Specifically, by simply placing conductive fabric 28 between the plies 20 and 22 of the wafer 10 at respective locations that extend between each aperture 12*a* and an associated contact 38 of the light 18, an electrical connection will be made that will complete a circuit from the hot prong of a plug 14 inserted in the wafer 10, to the light 18, and back to the neutral prong of the plug 14, as can easily be seen in FIG. 1. In some embodiments, the conductive fabric 28 may form a barrier in the apertures 12*a* that can be punctured by prongs 14 when the wafer 10 is first used, thus ensuring an electrical connection between the plug 14 and the fabric 28. In other embodiments, the fabric may be pre-cut in a manner that ensures such an electrical connection. In some embodiments, fasteners 26 such as screws, rivets, or pins, help ensure an electrical connection between the fabric 28 and the contacts 38.

It should be understood that the strips of conductive fabric material 28 are preferably electrically isolated from each other. This prevents a short in an electrical circuit that begins from the hot prong of a plug 16, through a first strip of conductive fabric to a positive terminal of a lamp circuit 30, and ends at the neutral prong of the plug 16 connected to the negative terminal of the lamp circuit 30 by a second strip of conductive material.

Figure 2:
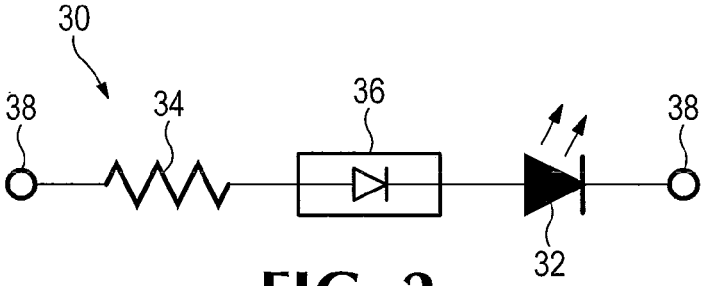
FIG. 2 shows a first embodiment of circuitry by which voltage across the prongs of the plug of FIG. 1 illuminates an LED light.

FIG. 2 shows one embodiment of a lamp circuit 30 that may be used in the wafer 10. The lamp circuit 30 may include two contacts 38 that are provided with a voltage potential across them when a plug, having the wafer 10 over its prongs, is inserted into a socket having power. Any such voltage potential across the contacts 38 will therefore propagate electric current through an LED 32, which then illuminates. A current-limiting resistor 34 preferably includes a resistance sufficient to limit the current to the LED 32 to a range that will not damage the LED 32. Those of ordinary skill in the art will appreciate that the resistance value of the resistor 34 will depend both on the voltage of the outlet the wafer 10 is intended to be used with, as well as the power rating of the LED 32. For example, if the voltage supplied by an outlet is 120 volts and the power rating of the LED 0.5 watts, the resistance of the resistor 34 may be 30 kOhms.

Figure 3:
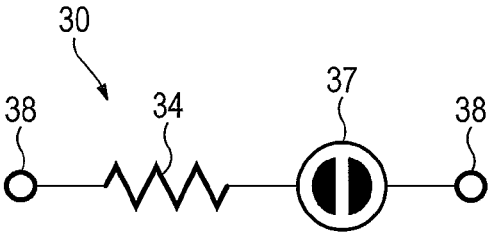
FIG. 3 shows a second embodiment of circuitry by which voltage across the prongs of the plug of FIG. 1 illuminates a neon light.

The lamp circuit 30 may also preferably include a diode 36 that limits current to flow in only the direction from the positive to the negative side of the LED 32. Diode 36 prevents current from flowing in the reverse direction through the LED 32, which might otherwise damage the LED 32. The frequency of AC current is high enough that fluctuations in the light emitted by the LED 32 will not be noticeable. Those of ordinary skill in the art will appreciate that other mechanisms may be used to prevent reverse current through the LED 32, such as a rectifier FIG. 3 shows an alternate lamp circuit 30 that includes a neon light 37 instead of an LED 32. Because the neon light 37 may operate directly on AC current, a diode 36 (or rectifier, etc.) is not needed. Those of ordinary skill in the art will appreciate that other light sources (filament bulbs, etc.) may also be used.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. An apparatus selectively connectable to the prongs of an electrical plug, the member comprising:

(a) a substrate having a first face and a second face, and a plurality of apertures configured to matingly receive one or more prongs of an electrical plug through the first face while the one or more prongs extend out of the second face;

(b) a light that activates when a voltage is provided across prongs extending out of the second face; where (c) the substrate includes a first ply attached to a second ply, and an electrically conductive fabric located between the first ply and the second ply, the electrically conductive fabric positioned to conduct electric current to a contact electrically connected to the light and from at least one prong when the prong is inserted in one of the apertures.

2. The apparatus of claim 1 where the substrate is less than ⅛ inch thick.

3. The apparatus of claim 1 where the substrate is less than 1/16 inch thick.

4. The apparatus of claim 1 where the substrate is flexible.

5. The apparatus of claim 1 where an electrically conductive fastener secures the first ply to the second ply, through the contact and the electrically conductive fabric.

6. A apparatus selectively connectable to the prongs of an electrical plug, the member comprising:

(a) a substrate having a plurality of apertures configured to matingly receive one or more prongs of an electrical plug, the substrate comprising a first ply attached to a second ply;

(b) a light having an associated electrical contact for receiving electrical current that illuminates the light; and (c) conductive fabric positioned between the first ply and the second ply, the conductive fabric extending from one of the plurality of apertures to the contact.

7. The apparatus of claim 6 having a first contact connected to a first terminal of the light and a second contact connected to a second terminal of the light, where a first conductive fabric extends from a first of the plurality of apertures to the first contact, and a second conductive fabric extends from a second of the plurality of apertures to the second contact.

8. The apparatus of claim 6 including a current-limiting resistor between the contact and the light.

9. The apparatus of claim 8 including at least one of a rectifier and a diode between the contact and the light.

10. The apparatus of claim 6 where the substrate is flexible.

11. The apparatus of claim 6 where the substrate has a first face and a second face, and where each of the plurality of apertures are configured to matingly receive a prong of an electrical plug through the first face while the prong extends from the second face.

12. The apparatus of claim 11 where the substrate is less than ⅛ inch thick.

13. The apparatus of claim 11 where the substrate is less than 1/16 inch thick.

14. The apparatus of claim 6 including an electrically conductive fastener that secures the conductive fabric to the contact.

15. An arrangement comprising:

(a) a plug having a base and a plurality of prongs extending from the base (b) an electrical outlet into which the prongs are inserted; and (c) a wafer positioned between the base and the outlet, the wafer completing an electrical circuit from a first of the plurality of prongs to a second of the plurality of prongs; wherein the wafer comprises a conductive fabric material electrically connecting the first of the plurality of prongs to a contact of a light; wherein the conductive fabric is located between a first ply and a second ply.

16. The arrangement of claim 15 including the light that illuminates when electricity flows through the wafer from the first of the plurality of prongs to the second of the plurality of prongs.

17. The arrangement of claim 15 where the wafer is less than ⅛ inch thick.

18. The arrangement of claim 15 where the wafer is less than 1/16 inch thick.

* * * * *